US007955194B2

(12) United States Patent
Avery

(10) Patent No.: US 7,955,194 B2
(45) Date of Patent: Jun. 7, 2011

(54) GOLF MAT

(75) Inventor: George S. Avery, Minneapolis, MN (US)

(73) Assignee: Textile Management Associates, Inc., Dalton, GA (US)

( * ) Notice: Subject to any disclaimer, the term of this patent is extended or adjusted under 35 U.S.C. 154(b) by 0 days.

(21) Appl. No.: 12/648,265

(22) Filed: Dec. 28, 2009

(65) Prior Publication Data

US 2010/0105497 A1 Apr. 29, 2010

Related U.S. Application Data

(63) Continuation of application No. 12/026,896, filed on Feb. 6, 2008, now abandoned, which is a continuation of application No. 10/845,858, filed on May 14, 2004, now abandoned, which is a continuation-in-part of application No. 10/733,806, filed on Dec. 10, 2003, now abandoned.

(51) Int. Cl.
*A63B 69/36* (2006.01)
*B32B 3/30* (2006.01)
*B32B 33/00* (2006.01)

(52) U.S. Cl. ..... 473/409; 473/278; 428/85

(58) Field of Classification Search ..... 473/278, 473/279; 428/17, 82, 85, 87, 88, 89, 92, 428/95, 97; 112/410, 475.01, 475.08, 475.17, 112/475.23

See application file for complete search history.

(56) References Cited

U.S. PATENT DOCUMENTS

| | | | | |
|---|---|---|---|---|
| 2,057,920 A | | 10/1936 | Rose | |
| 2,814,301 A | | 11/1957 | Schmitz | |
| 3,026,830 A | | 3/1962 | Bryant et al. | |
| 3,142,276 A | | 7/1964 | Shauer | |
| 3,298,079 A | | 1/1967 | Agett et al. | |
| 3,356,048 A | | 12/1967 | Haas | |
| 3,361,096 A | | 1/1968 | Watkins | |
| 3,595,185 A | | 7/1971 | Shorrock et al. | |
| 3,645,219 A | | 2/1972 | Jenkins | |
| 3,861,133 A | | 1/1975 | Frankfort et al. | |
| 3,940,522 A | * | 2/1976 | Wessells | 428/17 |
| 3,995,079 A | | 11/1976 | Haas, Jr. | |
| 4,029,029 A | | 6/1977 | Franks et al. | |
| 4,044,179 A | | 8/1977 | Haas, Jr. | |
| 4,096,226 A | | 6/1978 | Martin et al. | |

(Continued)

FOREIGN PATENT DOCUMENTS

DE 1902213 8/1970

(Continued)

*Primary Examiner* — Nini Legesse

(74) *Attorney, Agent, or Firm* — Kilpatrick Stockton & Townsend LLP

(57) ABSTRACT

A golf mat includes artificial grass fibers attached to and extending upward from a backing material, which may be one or more layers. The artificial grass fibers include groups of at least two different kinds of fiber sewn through a common path in the backing material. One of the kinds of fibers in each group is shaped so as to appear like a blade of grass. The other kind of fiber in each group is pre-stressed/crimped so that the relaxed shape of the fiber is nonlinear, resembling a curlicued or articulated form having lateral excursions. The lateral excursions cause portions of one such pre-stressed fiber to overlap and interfere with another, forming a mesh. The height of the pre-stressed fibers in their relaxed state in the turf is less than the height of the relatively unstressed artificial grass fiber(s). The crimped fibers form a resilient mat with impact characteristics similar to natural turf.

5 Claims, 4 Drawing Sheets

U.S. PATENT DOCUMENTS

| | | | | |
|---|---|---|---|---|
| 4,132,182 | A | 1/1979 | Heemstra | |
| 4,169,707 | A | 10/1979 | Gloeckler | |
| 4,173,192 | A | 11/1979 | Schmidt et al. | |
| 4,265,849 | A | 5/1981 | Borenstein | |
| 4,323,612 | A | 4/1982 | van Issum | |
| 4,396,653 | A | 8/1983 | Tomarin | |
| 4,419,944 | A | 12/1983 | Passons et al. | |
| 4,426,415 | A | 1/1984 | Avery | |
| 4,440,102 | A | 4/1984 | Card et al. | |
| 4,497,853 | A | 2/1985 | Tomarin | |
| 4,586,445 | A | 5/1986 | Card et al. | |
| 4,665,845 | A | 5/1987 | Card et al. | |
| 4,705,706 | A | 11/1987 | Avery | |
| 4,829,917 | A | 5/1989 | Morgante et al. | |
| 5,026,580 | A | 6/1991 | Hammon | |
| 5,224,434 | A | 7/1993 | Card et al. | |
| 5,348,785 | A | 9/1994 | Vinod | |
| 5,513,586 | A | 5/1996 | Neely et al. | |
| 5,601,886 | A | 2/1997 | Ishikawa et al. | |
| 5,706,745 | A | 1/1998 | Neely et al. | |
| 5,830,080 | A | 11/1998 | Reynolds | |
| 5,958,527 | A | 9/1999 | Prevost | |
| 5,979,344 | A | 11/1999 | Christman, Jr. | |
| 6,156,396 | A | 12/2000 | Florian | |
| 6,299,959 | B1 | 10/2001 | Squires et al. | |
| 6,491,991 | B2 * | 12/2002 | Seaton | 428/17 |
| 6,527,889 | B1 | 3/2003 | Paschal et al. | |
| 6,551,689 | B1 * | 4/2003 | Prevost | 428/143 |
| 6,746,752 | B2 | 6/2004 | Prevost | |
| 6,877,932 | B2 | 4/2005 | Prevost | |
| 6,895,877 | B1 | 5/2005 | Weiner | |
| 6,955,841 | B2 | 10/2005 | Weghuis et al. | |
| 7,060,334 | B2 | 6/2006 | Stroppiana | |
| 7,506,831 | B1 | 3/2009 | Weiner | |
| 2002/0146519 | A1 | 10/2002 | Carr et al. | |
| 2003/0093783 | A1 | 5/2003 | Nelson | |
| 2003/0099787 | A1 * | 5/2003 | Fink | 428/17 |
| 2004/0037975 | A1 | 2/2004 | Stroppiana | |
| 2004/0229007 | A1 | 11/2004 | Motz et al. | |
| 2004/0253390 | A1 | 12/2004 | Trafford | |
| 2006/0045994 | A1 | 3/2006 | Dipple et al. | |
| 2006/0045995 | A1 | 3/2006 | Dipple | |
| 2006/0093783 | A1 | 5/2006 | De Clerck | |
| 2008/0124496 | A1 | 5/2008 | Avery | |
| 2008/0125237 | A1 | 5/2008 | Avery | |

FOREIGN PATENT DOCUMENTS

| | | |
|---|---|---|
| DE | 3210784 | 12/1982 |
| EP | 0065622 | 12/1982 |
| EP | 0485871 | 5/1992 |
| EP | 0784109 | 7/1997 |
| FR | 1535468 | 8/1968 |
| FR | 1555112 | 1/1969 |
| GB | 1170749 | 11/1969 |
| GB | 1304151 | 1/1973 |
| GB | 1507201 | 4/1978 |
| JP | 44-13226 | 6/1969 |
| JP | 46-2180 | 1/1971 |
| JP | 46-23766 | 1/1971 |
| JP | 1131628 | 5/1989 |
| WO | WO-80-00649 | 4/1980 |

* cited by examiner

GOLF MAT

The present application is a continuation of U.S. patent application Ser. No. 12/026,896 filed Feb. 6, 2008 now abandoned, which is a continuation of U.S. patent application Ser. No. 10/845,858, filed May 14, 2004, now abandoned, which is a continuation-in-part of U.S. patent application Ser. No. 10/733,806, filed Dec. 10, 2003, now abandoned, the entire contents of all of which are incorporated herein by reference.

FIELD OF THE INVENTION

The present invention relates generally to golf mats, and more particularly to a golf mat having an artificial turf including a plurality of groups of fibers, each group including both non-linear fibers and substantially straight fibers sewn into a backing through a common opening, and having infill particles adhered to the non-linear fibers and lower portions of the straight fibers.

DESCRIPTION OF THE PRIOR ART

Golf mats for use as a practice playing surface are most effective if they simulate the feel of natural turf. A variety of mat constructions have been designed for this purpose. U.S. Pat. No. 6,156,396 uses a relatively thick base pad of resilient material (foam rubber), and an artificial grass-like carpet that is slidably positioned on the base so as to absorb club force, which is more like a natural turf than a rigidly mounted carpet.

U.S. Pat. No. 5,830,080 by Reynolds discloses a turf simulating surface including a grass-like carpet layer placed over layers of material, each layer designed to simulate the shock absorbing nature of corresponding layers of soil.

U.S. Pat. No. 4,497,853 by Tomarin, and U.S. Pat. No. 3,995,079 by Haas, Jr. also include layers of shock absorbing material beneath a grass simulating carpet. They also place granules, such as sand and/or rubber particles, covering/coating a lower portion of the grass-like carpet, giving support for the grass-like fibers and simulating the effect of soil. A disadvantage of the loose infill covering/coating in a golf mat is that it is displaced when impacted by a club head, which can result in undesirable variations in the infill depth, and air-born particles that can be irritating to the golfer.

SUMMARY

It is an advantage of this invention in that it provides a golf playing surface having an improved stability.

It is a further advantage of this invention in that it provides a golf mat with improved durability.

It is a still further advantage of this invention in providing a golf mat wherein a club stroke does not bottom out in the mat.

It is another advantage of this invention in providing a golf mat with improved shock absorption when a club head strikes the mat.

It is another advantage of this invention in that it provides a golf mat that will hold a golf ball tee without drilling a hole in the mat.

In one embodiment of this invention, a golf mat includes artificial grass fibers attached to and extending upward from a backing material, which may be one or more layers. The artificial grass fibers include groups of at least two different kinds of fiber sewn through a common path in the backing material. One of the kinds of fibers in each group is shaped so as to appear like a blade of grass. The other kind of fiber in each group is pre-stressed/crimped so that the relaxed shape of the fiber is nonlinear, resembling a curlicued or articulated form having lateral excursions. The lateral excursions cause portions of one such pre-stressed fiber to overlap and interfere with another, forming a mesh. The height of the pre-stressed fibers in their relaxed state in the turf is less than the height of the relatively unstressed artificial grass fiber(s). The crimped fibers form a resilient mat with impact characteristics similar to natural turf.

DESCRIPTION OF THE PREFERRED EMBODIMENTS

While the present invention will be described herein with reference to particular embodiments thereof, a latitude of modifications, various changes and substitutions are intended, and it will be appreciated that in some instances some features of the invention will be employed without a corresponding use of other features without departing from the spirit and scope of the invention as described with respect to the preferred embodiments set forth herein.

Figure 1A:
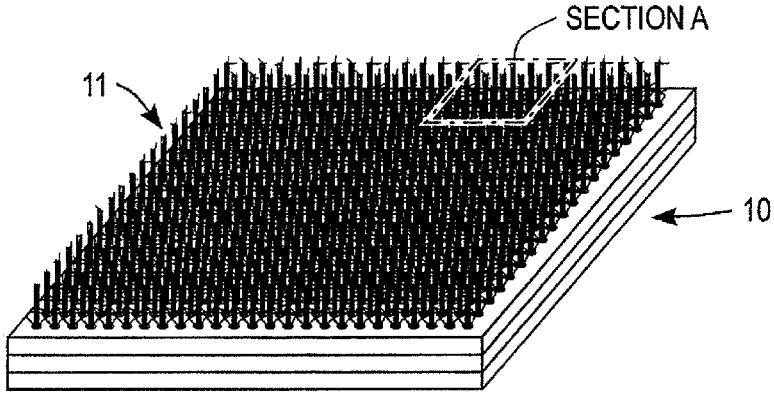
FIG. 1A illustrates a golf mat formed with artificial turf according to the present invention.
Figure 1B:
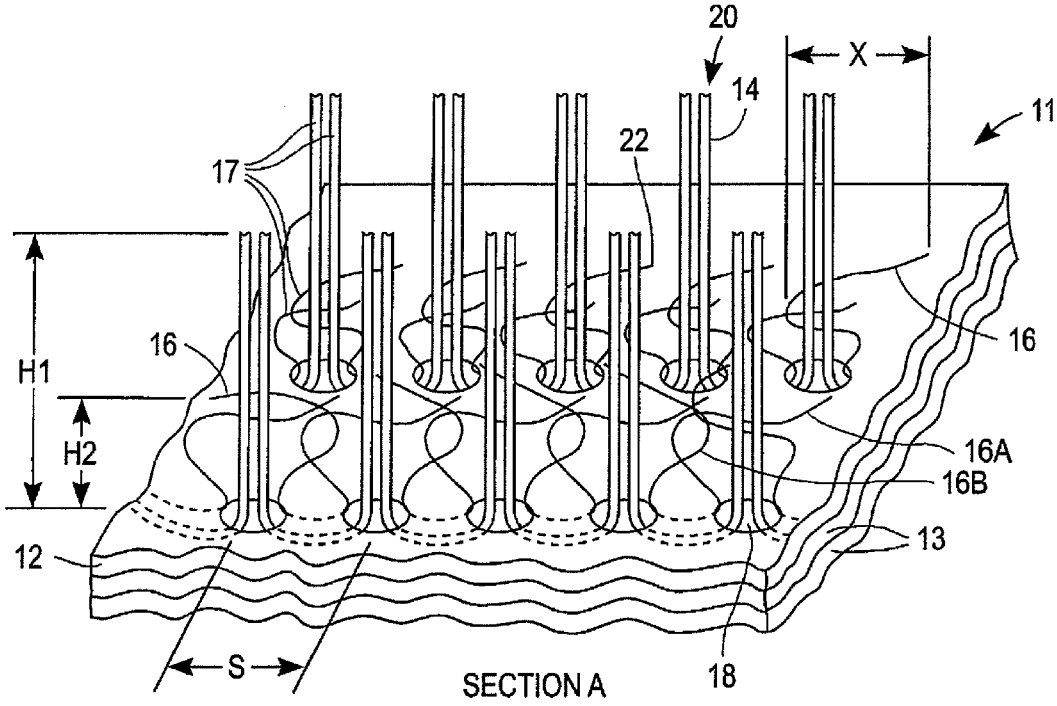
FIG. 1B is an enlargened view of a portion of FIG. 1A configured for illustrating the construction of the mat of FIG. 1A.

A golf mat 10 of the present invention is shown in FIG. 1A, having artificial turf 11. FIG. 1B is an enlargened view of a section "A" of the mat of FIG. 1A for illustrating the construction of the artificial turf 11, and also showing alternative base layers 13 which can be of any number, thickness and resiliency. The artificial turf 11 includes a backing material 12 with two different kinds of fiber 14 and 16 sewn into it. Groups of fibers, each group including at least one grass-like fiber 14 and one non-linear fiber 16 pass through the same passages 18 through the backing 12. Fiber 14 is an artificial grass blade that can be constructed in a number of ways to give the turf a grass-like appearance. Fiber 16 is pre-stressed into a non-linear shape. The tops 20 and 22 of the fibers are cut, forming cut ends, and thereby forming a "cut fiber" carpet/artificial turf, resulting in the fiber 14 appearing grass-like. The fibers 14 are relatively un-stressed and have only minor deviations from linearity, similar to a linear/straight grass blade appearance. Fibers 16 are pre-stressed prior to being sewn into the backing 12, and upon being sewn into the backing 12 and released from the sewing machine, they return to a non-linear shape. The sewing machine applies tension to the fiber 16, holding it in a linear shape as it is sewn. Once released by the sewing machine, the fibers 16 retract into their pre-stressed non-linear shape, causing them to form a mesh of fibers at a level below that of the straight fibers 14 as shown in FIG. 1. In this way, the fiber mesh including a lower portion of the fibers 14 and the fibers 16 resembles grass thatch. The golf mat therefore provides a resistance that is similar to natural grass turf when a golf club head impacts the mat. The club head first impacts the taller, grass-like fiber portions that extend above the height of the non-linear fibers 16. These portions provide resistance to the club head in a similar manner to natural grass. If the upper portion of grass-like fibers 14 does not stop the club head, the head then impacts the mesh, consisting of lower portions of the fibers 14 and the non-linear fibers 16, which provides further resistance to the club head, similar to a club head hitting the thatch in natural turf. The non-linear fibers 16 have lateral excursions, for example as indicated by the letters "x" for one fiber 16 in FIG. 1B. FIG. 1B shows 10 groups, such as group 17 of fibers, with each group of fibers sewn through a common path 18 through the backing 12. The fibers 16 and group spacing "S" are configured so that the lateral excursion of one such fiber 16 of one group overlaps the lateral excursion of a fiber 16 from an adjacent group, and forms a mesh of overlapping fibers 16. For example, note that the excursion of fiber 16A of one group overlaps the excursion of fiber 16B from an adjacent group. The height of the installed non-linear fibers 16 is noted as "$H_2$" which is less than the height $H_1$ of the grass-like fibers. A preferred height $H_1$ is ⅞ inch, and a preferred range of $H_1$ is from ⅞" to 3" A preferred height of $H_2$ is ⅝ inch, and a preferred range of $H_1$ is from ⅝" to 2½" For the golf mat as disclosed, the fibers are preferably sewn with a stitch spacing S in the range of 0.350" to 0.375" with a preferred spacing of 0.350", but other values of S are also included in the present invention. The combination of the grass-like fibers 14 and non-linear fibers 16 provides a shock absorbing and somewhat resilient layer, similar to that experienced on natural turf which generally has a layer of shock absorbent thatch. The tufted carpet/golf mat shown in FIGS. 1A and 1B as described includes the fibers 14 and 16 which are yarns/threads of synthetic material such as polypropylene, polyethylene, nylon or other synthetic yarns. The structure of FIGS. 1A and 1B is an improvement over the prior art in that it is more durable, is more grass-like in appearance and structure, and provides more cushion. Although two different yarns/fibers are shown sewn through common openings in the backing 12, the present invention also includes other numbers of yarn/fibers sewn through common openings. The fibers/yarn can have different constructions, denier, twist, and crimp. The golf mat shown is rectangular, but it can be of any shape, including square, octagonal, rectangular, etc. The method of construction of the golf mat 10 differs from the prior art in that it is sewn with multiple yarns through a single needle eye. This will be illustrated more clearly in reference to FIG. 3.

The layer of height $H_2$ including the crimped/non-linear fibers 16 forms a cushion resembling natural grass thatch, and reduces shock and resists bottoming out of a golf club stroke. This reduced shock and resistance to bottoming out is a significant improvement over artificial turf having only fibers similar to the grass-like fibers 14.

Figure 2:
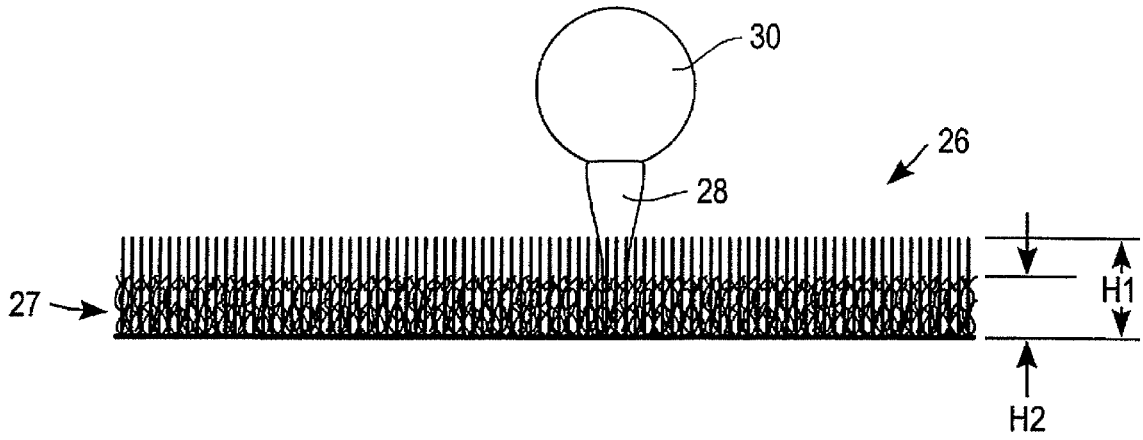
FIG. 2 illustrates a golf tee held by the golf mat.

Another useful feature/embodiment of the present invention is illustrated in FIG. 2, wherein a golf mat 26 constructed as described above, has a lower, more dense portion 27 with fibers including both the straight 14 and crimped 16 fibers, that is sufficiently dense so as to hold a golf tee 28 erect with a golf ball 30 thereon as shown. A preferred height $H_1$ of the grass-like fibers is approximately ⅞ inch, with a preferred height range of ⅞" to 3". A preferred height range of $H_2$ of the crimped fibers is ⅝ inch, with a preferred range of ⅝" to 2½". A preferred weight of the mat, not including alternative layers 13, is in the range of 60 to 90 ounces per square yard. The structure shown in FIG. 2 avoids the need for prior art structures such as drilling a hole in the mat for holding a golf tee, or using a vertical rubber tube for simulating a golf tee.

During the sewing process, fibers 14 and 16 are both threaded together through the same sewing machine needle passages, and therefore pass through the same passages 18 through the backing through which the needle is inserted. Axial/longitudinal tension is provided on the fibers 14 and 16 by the sewing machine, which keeps both fibers 14 and 16 in a controlled/tensioned line, and most importantly, fibers 16 are held in an uncrimped, straight line. Upon being sewn into the backing 12, the tension on fiber 16 is released and it returns to its pre-stressed/crimped condition, that could be described as curlicued.

In one embodiment, the fibers 14 are constructed of polyethylene and fibers 16 of nylon. The polyethylene has a slick surface similar to a grass blade, which provides comparable resistance to a golf club head when the turf is in a golf mat. In a further embodiment of the present invention, the turf 11 can be a playing field such as a football field, and the slick surface helps avoid a player from twisting an ankle, which would more easily occur if the turf has a high coefficient of friction. The dimensions of the stitch spacing S and row spacing R, are preferably selected along with the design of the pre-stressed shape of the fiber 16, so that lateral excursions of a fiber 16 from one passage 18 overlap the excursions of a fiber 16 from an adjacent passage 18. In this way, in one embodiment an effective mesh of fiber 16 is formed to hold a golf tee. The density of fibers and fiber overlap can also can be configured so as to resemble natural turf.

Figure 3:
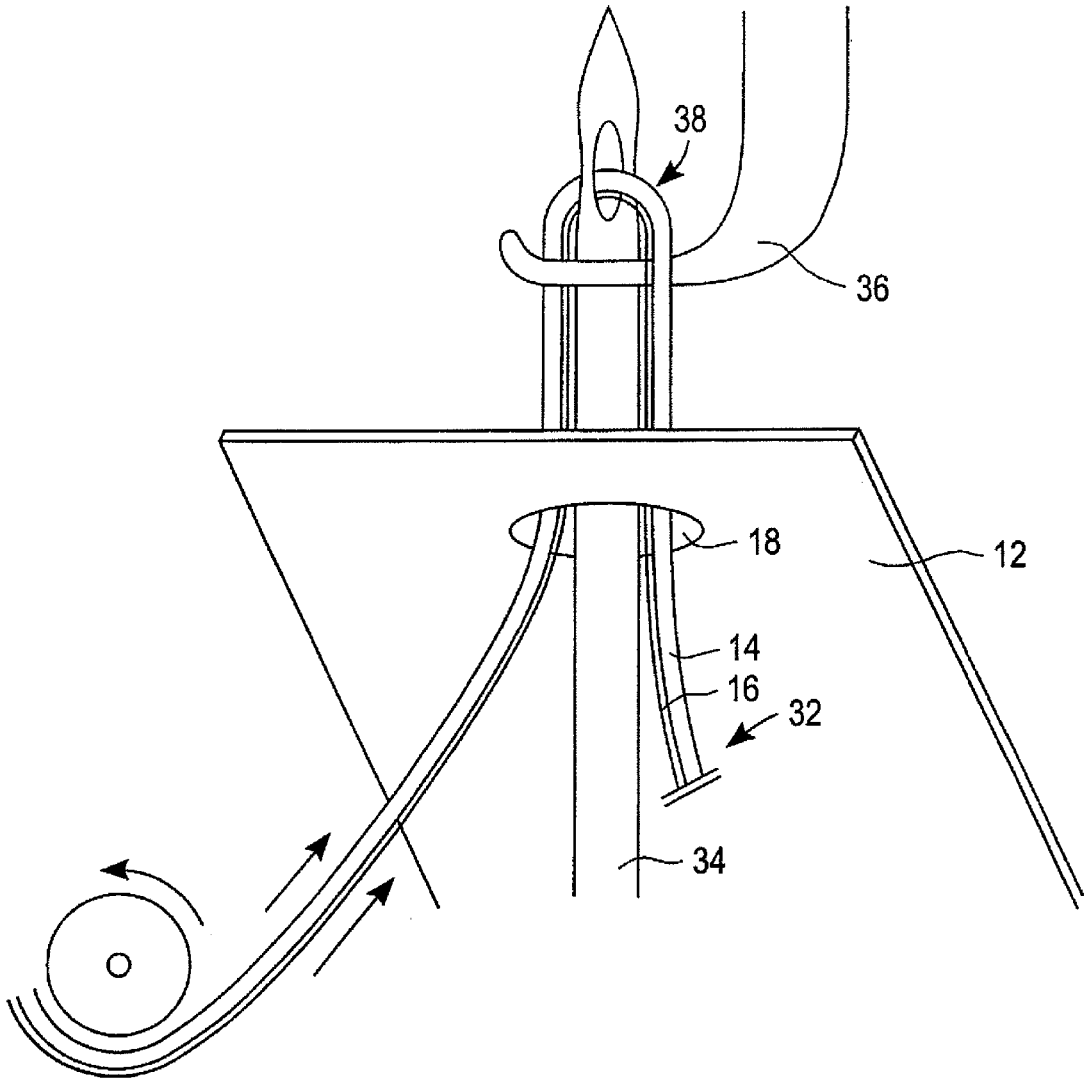
FIG. 3 illustrates two fibers through one needle, and fiber tension.

FIG. 3 is provided to illustrate the tension applied to the fibers 14 and 16 during the process of sewing. The initial ends 32 of the fibers 14 and 16 are secured during the process. The needle 34 is inserted through the backing 12, taking both fibers 14 and 16 through a common passage 18. A hook 36 grabs the loop of fibers and keeps the fibers from retracting back through the passage 18 as the needle 34 is retracted. The sewing machinery then inserts the needle 34 through the backing again at a stitch space "S" (FIG. 1B) from the first space 18 and the hook 36 grabs the material again. A cutting tool (not shown) follows along or is integrated with the hook apparatus 36 and cuts the loop ends 38, at which time the tension on the cut fiber 16 is released and the fiber 16 returns to its curlicued/non-linear state as shown in FIG. 1B.

In one embodiment, the fibers 14 are constructed of polyethylene, and extend upward from the backing a distance $H_1$ of approximately ⅞ inches. The retracted, rest state curlicued fibers 16 extend upward from the backing a distance $H_2$ of approximately ⅝ inches. Other dimensions are also included in the spirit of the present invention, as will be apparent to those skilled in the art. In general, the height $H_2$ of the curlicued fiber 16 must be shorter than the height of the relatively straight fiber 14.

As described above, the straight fiber 14 may be constructed from polyethylene, which provides a slippery surface similar to grass. Other materials that simulate the grass-like property of low resistance/friction are also included in the spirit of the present invention. The nylon fiber 16 is selected to be resilient. Other materials for fiber 16 are also included in the spirit of the present invention.

Figure 4A:
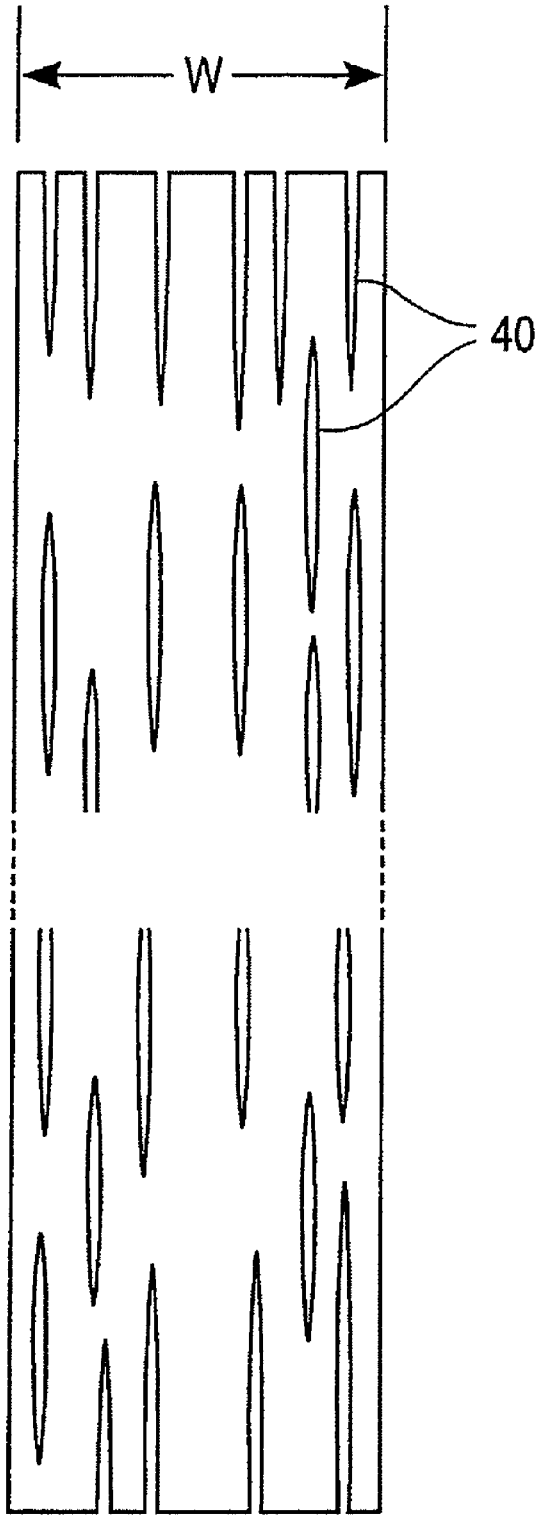
FIG. 4A shows one type of artificial grass fiber construction.
Figure 4B:
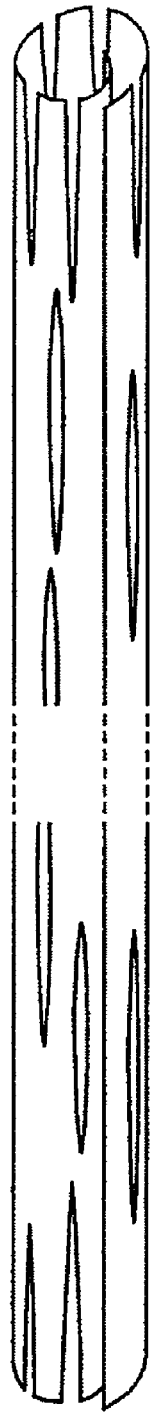
FIG. 4B shows the fiber of FIG. 4A rolled up.

The grass-like fibers 14 can be constructed in a variety of ways that will be apparent to those skilled in the art for use in the turf/mat of the present invention, and the present invention includes the use of these constructions in the turf structure as described in reference to the figures of the present disclosure. FIG. 4A illustrates the construction of one type of grass-like structure for use as an artificial grass blade. A length of polyethylene or other material of width "W" is sliced through in places 40 as indicated. The material is then rolled up, or pre-stressed to automatically roll up, as indicated in FIG. 4B, and when sewn into an artificial turf "backing", it resembles a blade of grass.

While the present invention has been described herein with reference to particular embodiments thereof, a latitude of modifications, various changes and substitutions are intended in the foregoing disclosure, and it will be appreciated that in some instances some features of the invention will be employed without a corresponding use of other features without departing from the spirit and scope of the invention as set forth in the appended claims.

The invention claimed is:

1. A method of manufacture of a golf mat providing initial resistance, followed by secondary resistance resisting bottoming out, to a golf club head impacting the mat, the method comprising:

(a) providing a mat backing suitable for receiving fiber tufts, (b) tufting into the backing a plurality of groups of fibers, wherein each group includes:

(i) a combination of at least one resilient first fiber prestressed so as to have a curlicued shape when not under tension, and (ii) at least one second fiber shaped to resemble a grass blade, and wherein the tufting comprises sewing each of the first and second fibers of each group using a single needle through a common path through the backing, while applying tension to hold the first fibers during sewing, (d) cutting the first and second fibers and releasing them from a sewing machine to extend from the backing to a cut end, (e) permitting the first fibers to retract into their prestressed non-linear shape and to overlap to form a mesh of fibers resembling natural grass thatch at a level below that of the second fibers extending above the mesh, wherein the second fibers provide initial resistance to a golf club head impacting the mat, and the first fibers provide secondary resistance to a golf club head reducing shock and resisting bottoming out, and wherein the second fibers extend from the backing a second height, wherein the second height is in the range of ⅞ to 3 inches, and the curlicued fibers extend from the backing a first height, wherein the first height is in the range of ⅝ to 2 inches.

2. A method as recited in claim 1 wherein the groups are spaced apart such that the curlicued first fiber of one group overlaps the curlicued first fiber of an adjacent group thereby providing a mesh of overlapping first fibers.

3. A method as recited in claim 2 wherein the groups of first fibers are in rows separated by distances in the range of 0.350 to 0.375 inch.

4. A method as recited in claim 1 wherein the first fiber is made from nylon.

5. A method as recited in claim 1 wherein the second fiber is made from polyethylene.

* * * * *